US010871280B2

(12) United States Patent
Wu et al.

(10) Patent No.: US 10,871,280 B2
(45) Date of Patent: Dec. 22, 2020

(54) CONNECTION TERMINAL AND ILLUMINATION DEVICE

(71) Applicant: SHANGHAI LUMIXESS LIGHTING TECHNOLOGY COMPANY, Shanghai (CN)

(72) Inventors: Xin Wu, Shanghai (CN); Zhong Chen, Shanghai (CN); Xinsheng Wang, Shanghai (CN)

(73) Assignee: SHANGHAI LUMIXESS LIGHTING TECHNOLOGY COMPANY, Shanghai (CN)

( * ) Notice: Subject to any disclaimer, the term of this patent is extended or adjusted under 35 U.S.C. 154(b) by 0 days.

(21) Appl. No.: 16/275,606

(22) Filed: Feb. 14, 2019

(65) Prior Publication Data

US 2020/0208823 A1 Jul. 2, 2020

(30) Foreign Application Priority Data

Dec. 27, 2018 (CN) ..... 2018 1 1620119
Dec. 27, 2018 (CN) ..... 2018 2 2229242 U

(51) Int. Cl.

| | |
|---|---|
| ***H05B 33/08*** | (2020.01) |
| ***F21V 23/06*** | (2006.01) |
| ***F21V 23/02*** | (2006.01) |
| ***H05B 45/37*** | (2020.01) |

(52) U.S. Cl.
CPC ..... *F21V 23/06* (2013.01); *F21V 23/02* (2013.01); *H05B 45/37* (2020.01)

(58) Field of Classification Search
CPC ..... H05B 33/0809; H05B 33/0815; H05B 33/0827; H05B 33/0833; H05B 33/0845; H05B 45/37
USPC ..... 315/274, 291
See application file for complete search history.

(56) References Cited

U.S. PATENT DOCUMENTS

2007/0252535 A1* 11/2007 Fukumoto ..... H05B 41/2827 315/291
2008/0122781 A1* 5/2008 Namki ..... G09G 3/3406 345/102
2010/0289422 A1* 11/2010 Wei ..... H05B 33/0827 315/239
2011/0149563 A1* 6/2011 Hsia ..... H01R 33/945 362/221

(Continued)

*Primary Examiner* — Tung X Le
(74) *Attorney, Agent, or Firm* — Ohlandt, Greeley, Ruggiero and Perle, LLP

(57) ABSTRACT

A connection terminal is provided, including at least one impedance branch circuit, where each impedance branch circuit includes one or more impedance elements and two first conductive connectors, each first conductive connector has a first end and a second end, first ends of the two first conductive connectors are configured to be coupled with a driving power supply and an illumination lamp, and second ends of the two first conductive connectors are configured to be coupled with two ends of the one or more impedance elements. An illumination device is provided, including a driving power supply, an illumination lamp and the connection terminal in the present disclosure, input ends of the driving power supply are coupled with an AC power grid, its out ends are coupled with two ends of the illumination lamp to form a driving circuit, and the connection terminal is connected to the driving circuit.

20 Claims, 12 Drawing Sheets

(56) References Cited

U.S. PATENT DOCUMENTS

| | | | | |
|---|---|---|---|---|
| 2012/0043892 | A1* | 2/2012 | Visser | H01R 13/4538 315/121 |
| 2013/0320869 | A1* | 12/2013 | Jans | H05B 45/14 315/186 |
| 2017/0105263 | A1* | 4/2017 | Xiong | F21V 3/061 |
| 2019/0230756 | A1* | 7/2019 | Jiang | F21V 23/023 |
| 2019/0335561 | A1* | 10/2019 | Wu | H05B 33/0884 |

* cited by examiner

CONNECTION TERMINAL AND ILLUMINATION DEVICE

CROSS-REFERENCE TO RELATED APPLICATIONS

This application claims the benefit of priority to Chinese Patent Application No. 201811620119.3 and Chinese Patent Application No. 201822229242.4, titled "CONNECTION TERMINAL AND ILLUMINATION DEVICE", filed on Dec. 27, 2018, the entire disclosure of which are incorporated herein by reference.

TECHNICAL FIELD

The present disclosure relates to lighting technology field, and more particularly, to a connection terminal and an illumination device.

BACKGROUND

Due to advantages of long service life, high luminous efficiency, no radiation, impact resistance and low power consumption, LED (Light-Emitting Diode) lamps have been widely used in various environments. LED lamps belong to an energy-efficient and environment protecting lighting source. On the other hand, due to the strong individual requirements of LED lamps, combined with the differentiated design of LED lamp bars, resulting in that even with a same type of lamp beads, operating voltages and operating currents of LED lamps may vary obviously when lamp beads included in a lamp bar are different in number and connection ways.

There are thousands of light bars with different specifications and different powers in the market, and thousands of driving power supplies with corresponding specifications and corresponding powers. On one hand, users have to choose an appropriate driving power supply among the multiple driving power supplies to meet lighting requirements of their LED lamps. On the other hand, the driving power supply manufacturers need to prepare abundant power supply inventory to meet customers' personalized service and fast delivery requirements. This phenomenon not only causes a large increase in production cost and inventory management difficulty to the driving power supply manufacturers, as well as a great waste of social resources, but also reduces user experience and flexibility of assembly and retrofitting of LED lamps. Especially when the driving power supply of an LED lamp is damaged, the user usually needs to replace the entire illumination device because it is difficult to find an LED driving power supply that meets the user's specific demands.

SUMMARY

In order that an illumination lamp and a driving power supply can be matched with each other in a more convenient way, and illumination lamps can output various illuminance to meet different environments' and users' individual demands with greatly reduced specifications of illumination lamps and driving power supplies, a connection terminal and an illumination device are provided according to embodiments of the present disclosure.

In some embodiments, the connection terminal may include: at least one impedance branch circuit, where each of the at least one impedance branch circuit may include: one or more impedance elements; and two first conductive connectors, each of the two first conductive connectors having a first end and a second end, wherein the first ends of the two first conductive connectors are configured to be coupled with a driving power supply and an illumination lamp respectively, and the second ends of the two first conductive connectors are configured to be coupled with two ends of the one or more impedance elements respectively.

In some embodiments, the one or more impedance elements may include a capacitor.

In some embodiments, a capacitance of the impedance branch circuit ranges from 33 pF to 63 nF.

In some embodiments, the impedance branch circuit may include a plurality of impedance elements, with the plurality of impedance elements being connected in series or in parallel between the two first conductive connectors.

In some embodiments, the connection terminal may further include a terminal body, being made of an insulating material, wherein the one or more impedance elements and the each first conductive connector are disposed in the terminal body, and the first end of the each first conductive connector is provided with a port exposed outside the terminal body.

In some embodiments, the two ports of the first ends of the two first conductive connectors are disposed at a same end of the terminal body; or the two ports of the first ends of the two first conductive connectors are respectively disposed at two ends of the terminal body.

In some embodiments, the connection terminal may further include at least one second conductive connector, each of the at least one second conductive connector having a first end and a second end, wherein the second end of the second conductive connector is disconnected or short-circuited with the second end of the first conductive connector, and the first end of the first conductive connector and the first end of the second conductive connector are configured to be respectively coupled with a driving power supply and an illumination lamp, or are configured to be respectively coupled with an illumination lamp and a driving power supply.

In some embodiments, the connection terminal may further include a plurality of second conductive connectors, each of the plurality of second conductive connectors having a first end and a second end, wherein the first ends of a group of second conductive connectors are configured to be respectively coupled with a driving power supply and an illumination lamp, the second ends of the group of second conductive connectors are disconnected or short-circuited with each other, and the group of second conductive connectors may include two second conductive connectors.

In some embodiments, the driving power supply is configured to output an alternating current power and the illumination lamp is configured to be driven by an alternating current power. In some embodiments, the driving power supply is configured to output a high frequency alternating current power, and the illumination lamp is configured to be driven by a high frequency alternating current power.

An illumination device is also provided according to embodiments of the present disclosure.

In some embodiments, the illumination device may include a driving power supply, an illumination lamp, and the connection terminal according embodiments of the present disclosure; wherein input ends of the driving power supply are configured to be coupled with an alternating current power grid, and output ends of the driving power supply are configured to be coupled with two ends of the illumination lamp to form a driving circuit, and the two first conductive connectors of at least one impedance branch circuit of the connection terminal are connected to the driving circuit.

In some embodiments, the one or more impedance elements between the two first conductive connectors of the at least one impedance branch circuit are connected in series with the illumination lamp.

In some embodiments, the driving power supply is configured to output an alternating current power, and the illumination lamp may include: an AC-DC conversion circuit and at least one light emitting element, input ends of the AC-DC conversion circuit are coupled with the output ends of the driving power supply, and output ends of the AC-DC conversion circuit are coupled with two ends of the at least one light emitting element, and the AC-DC conversion circuit is configured to convert an alternating current power into a direct current power.

In some embodiments, an impedance of the one or more impedance elements of the connection terminal is determined by a lumen output of the illumination lamp.

In some embodiments, the illumination device may include a plurality of illumination lamps being connected in series in the driving circuit; the illumination device may include one or more connection terminals, and at least one impedance branch circuit of the one or more connection terminals is coupled to the driving circuit.

In some embodiments, the illumination device may include a plurality of illumination lamps, and the driving power supply may include a plurality groups of output ends, with two ends of each of the plurality of illumination lamps being coupled with one of the plurality groups of output ends of the driving power supply so as to form a plurality of driving circuits; wherein the illumination device may include one connection terminal, the one connection terminal may include a plurality of impedance branch circuits, and the plurality of impedance branch circuits of the one connection terminal are respectively coupled to the plurality of driving circuits, or the illumination device may include a plurality of connection terminals, and the impedance branch circuits of the plurality of connection terminals are respectively coupled to the plurality of driving circuits.

In some embodiments, the driving power supply may include a common output end, the plurality groups of output ends of the driving power supply share the common output end, one end of each of the plurality of illumination lamps is coupled with the common output end; the illumination device may include a connection terminal, an impedance branch circuit of the connection terminal is connected in series between the common output end of the driving power supply and the one end of the each illumination lamp.

In some embodiments, the illumination lamp may include a lamp tube, the lamp tube is double ended or single ended, the double ended lamp tube may include a straight lamp tube, and the single ended lamp tube may include a U-shaped, ring-shaped, H-shaped, double U-shaped, square-shaped, sphere-shaped or spiral-shaped lamp tube.

In some embodiments, the illumination lamp may include a first light emitting element and a second light emitting element with different color temperatures; the driving power supply may include a first group of output ends and a second group of output ends, the first group of output ends are coupled with two ends of the first light emitting element to form a first driving circuit, and the second group of output ends are coupled with two ends of the second light emitting element to form a second driving circuit; and the illumination device may include one connection terminal, the one connection terminal may include at least two impedance branch circuits, and two impedance branch circuits of the one connection terminal are respectively coupled to the first driving circuit and the second driving circuit, or the illumination device may include two connection terminals, and impedance branch circuits of the two connection terminals are respectively coupled to the first driving circuit and the second driving circuit.

In some embodiments, the illumination lamp may further include: a first AC-DC conversion circuit, input ends of the first AC-DC conversion circuit being coupled with the first group of output ends of the driving power supply, output ends of the first AC-DC conversion circuit being coupled with the two ends of the first light emitting element, and the first AC-DC conversion circuit being configured to convert an alternating current power into a direct current power; and a second AC-DC conversion circuit, input ends of the second AC-DC conversion circuit being coupled with the second group of output ends of the driving power supply, output ends of the second AC-DC conversion circuit being coupled with the two ends of the second light emitting element, and the second AC-DC conversion circuit being configured to convert an alternating current power into a direct current power.

Compared with the prior art, the present disclosure has the following advantages.

The connection terminal according to embodiments of the present disclosure includes at least one impedance branch circuit, wherein each of the at least one impedance branch circuit includes two first conductive connectors and one or more impedance elements connected in series between the two first conductive connectors. Current of a circuit to which the connection terminal is coupled via the two first conductive connectors can be adjusted by the one or more impedance elements. In practical applications, an operating current of a circuit can be set by connecting a connection terminal with a specific impedance to the circuit; and an operating current of a circuit can be adjusting on-site by configuring a plurality of connection terminals with different impedances, and connecting an appropriate one in the circuit. For example, the connection terminal may be applied in assembling and retrofitting of illumination lamps in lighting circuits.

Further, each of the one or more impedance elements may include a capacitor, and when the connection terminal is connected to a circuit, the capacitor will not bring additional power loss to the circuit; and due to the small sizes and low costs of capacitors, using a capacitor as the impedance element of the connection terminal has a great practical value.

Further, the connection terminal may further include at least one second conductive connector, and the at least one second conductive connector may be short-circuited or disconnected with the first conductive connector. When the connection terminal is connected to a circuit through the first conductive connector and the second conductive connector, the circuit will be turned on or turned off; or the connection terminal may further include a plurality of second conductive connectors, the plurality of second conductive connectors may be short-circuited or disconnected with each other, and when the connection terminal is connected to a circuit through two second conductive connectors, the circuit will be turned on or turned off. Therefore, the connection terminal according to embodiments of the present disclosure may include different types of conductive connectors, and different functions can be realized when the connection terminal is connected to a circuit through different types of conductive connectors, thereby improving integration of the connection terminal.

An illumination device is also provided according to embodiments of the present disclosure, including a driving power supply, an illumination lamp, and the aforementioned connection terminal, wherein output ends of the driving power supply are coupled with two ends of the illumination lamp to form a driving circuit, two first conductive connectors of the impedance branch circuit of the connection terminal are connected to the driving circuit to adjust an operating current of the illuminating lamp, thereby adjust a lumen output of the illumination lamp. In practical applications, manufacturers can produce connection terminals of different specifications, the installation or maintenance staff only need to connect electrical wires of the driving power supply and electrical wires of the illumination lamp respectively with the two first conductive connectors of the connection terminal of a specific specification, so as to achieve an on-site adjustment of illuminance of an illumination lamp in a convenient, quick and safe way, which can further meet different illuminance requirements of different environments, and is particularly suitable for large-scale assembling and retrofitting of illumination lamps.

In the illumination device according to embodiments of the present disclosure, an lumen output of the illumination lamp can be adjusted by connecting connection terminals of different specifications, which has the following advantages: firstly, requirements for various specifications of illuminating lamps and various specifications of driving power supplies can be greatly reduced, because only a few specifications of illuminating lamps and driving power supplies with a variety of connection terminals, can easily satisfy a wide range of illumination demands, thereby greatly reducing production cost and inventory management difficulty of manufacturers and suppliers; secondly, due to the low cost and small size of the connection terminal, it is easy to stock, and the adaptation between the illumination lamp and the driving power supply can be flexibly solved; thirdly, compared with using a programmable LED driving power supply, it does not require high professional skills of staffs who assemble illumination lamps on site by using the connection terminal. The connection terminal is easy to operate, thereby promoting application of this new technology.

Further, the one or more impedance elements of the connection terminal may be connected in series with the illumination lamp, so that it is convenient for the connection terminal to be connected to the driving circuit of the illumination lamp, and a precise adjustment of the operating current of the illumination lamp can be realized.

Further, the illumination device may include a plurality of illumination lamps, which may be connected in series in a same driving circuit. Then, operating currents and lumen outputs of the plurality of illumination lamps can be adjusted by connecting at least one impedance branch circuit in the driving circuit. The connection of at least one impedance branch circuit in the driving circuit can be achieved by connecting one or more connection terminals in the driving circuit.

Further, the illumination device may include a plurality of illumination lamps, which may be respectively connected in a plurality of driving circuits. In this case, a separate impedance branch circuit needs to be connected in each driving circuit to realize an adjustment of an operating current of each illumination lamp. Connection of the impedance branch circuit in each driving circuit can be realized either by multiple impedance branch circuits of one connection terminal, which is beneficial to improve the integration level of the connection terminal; or by impedance branch circuits of a plurality of connection terminals, which is beneficial to improve assembly and retrofitting flexibility.

Further, the illumination lamp may include a first light emitting element and a second light emitting element having different color temperatures, and the first light emitting element and the second light emitting element are respectively connected in the first driving circuit and the second driving circuit. Two impedance branch circuits can be respectively connected to the two driving circuits to achieve respective adjustments of operating currents of the first and second light emitting elements, and further to achieve setting or adjustment of the overall color temperature of the illumination lamp. Connection of the two impedance branch circuits in the two driving circuits respectively can be realized via two impedance branch circuits of one connection terminal, which is beneficial to improve the integration level of the connection terminal; or by impedance branch circuits of two connection terminals respectively, which is beneficial to improve assembly and retrofitting flexibility.

DETAILED DESCRIPTION

In order to make the above-mentioned objects, features and advantages of the present disclosure more easily understood, specific embodiments of the present disclosure will be described in detail with reference to the accompanying drawings below. Apparently, embodiments described below are merely a portion of embodiments of the present disclosure, and are not all embodiments. All other embodiments obtained by those of ordinary skill in the art without making creative work are within the scope of the present disclosure, based on embodiments disclosed hereinafter. The various embodiments in the specification are described in a progressive manner, and each embodiment focuses on differences from other embodiments, and the same or similar parts among the various embodiments may be referred to each other.

Figure 1:
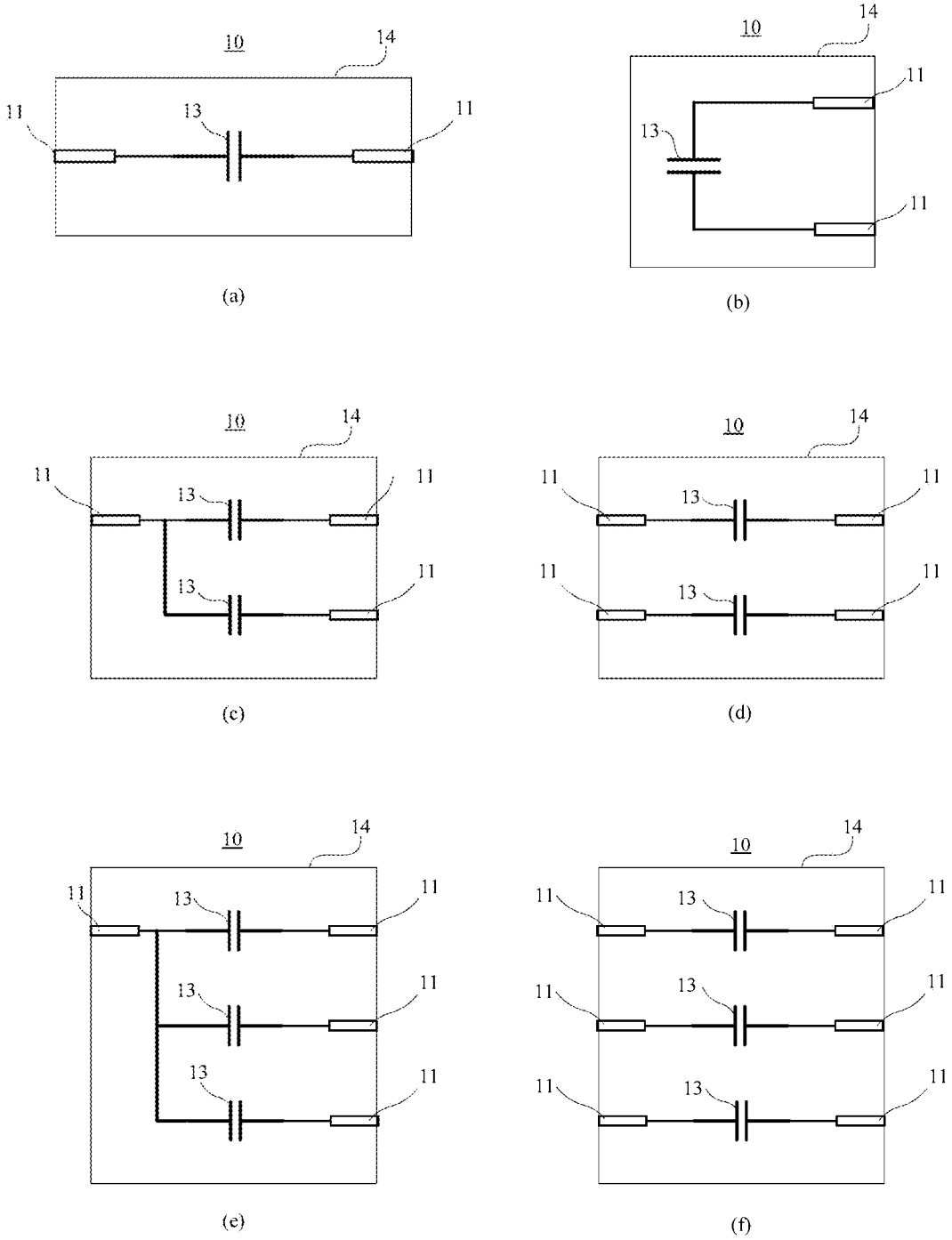
FIG. 1 schematically illustrates structural diagrams of connection terminals 10 according to an embodiment of the present disclosure.

A connection terminal is provided according to embodiments of the present disclosure. Referring to FIG. 1, FIG. 1 schematically illustrates structural diagrams of connection terminals 10 according to an embodiment of the present disclosure.

In some embodiments, the connection terminal 10 may include: at least one impedance branch circuit, each of the at least one impedance branch circuit may include one or more impedance elements 13 (only one impedance element 13 is shown in FIG. 1 for simplification) and two first conductive connectors 11, each of the two first conductive connectors 11 has a first end and a second end, the first ends of the two conductive connector 11 are respectively configured to be coupled with wires, and the second ends of the two first conductive connectors 11 are configured to be coupled with two ends of the one or more impedance elements 13 respectively.

In some embodiments, the first ends of the two first conductive connectors 11 are configured to be coupled with a driving power supply and an illumination lamp, respectively.

It should be noted that, the connection terminal may include different types of conductive connectors. In the present disclosure, the conductive connectors are divided into different types according to whether an impedance element is connected between two conductive connectors. Two conductive connectors with at least one impedance element connected therebetween are each defined as a "first conductive connector". Two conductive connectors being disconnected or shorted with each other are each defined as a "second conductive connector". A conductive connector disconnected or shorted with the first conductive connector is also defined as a "second conductive connector". It should be mentioned that, the two definitions of the "first conductive connector" and the "second conductive connector" do not conflict with each other. For any conductive connector, it may serve as a first conductive connector in a circuit formed by the any conductive connector and another conductive connector; while it may serve as a second conductive connector in a circuit formed by the any conductive connector and another conductive connector.

In some embodiments, the connection terminal 10 may further include a terminal body 14, the terminal body may be made of an insulating material, the one or more impedance elements 13 and the first conductive connector 11 may be disposed in the terminal body 14, and the first end of the first conductive connector 11 may have a port (not shown) exposed outside the terminal body 14 to be connected with a wire. The first conductive connector 11 may be made of a metal conductor and may have a variety of structures. For example, an interior of the first conductive connector 11 may be provided with a spring to clamp a wire inserted from the port of the first conductive connector 11, and the second end of the first conductive connector 11 may be connected with an end of the one or more impedance elements 13 via a wire; or the first conductive connector 11 may be a wire, and the wire may be connected with the one or more impedance elements 13; or the two first conductive connectors 11 may be leads or pins disposed at both ends of the one or more impedance elements 13.

In some embodiments, the connection terminal 10 may include one impedance branch circuit (as shown in FIGS. 1(*a*) and (*b*)), and the ports of the first ends of the two first conductive connectors 11 may be respectively disposed at two ends of the terminal body 14 (as shown in FIG. 1(*a*)). For example, the terminal body 14 may be a hexahedron, and the ports of the first ends of the two first conductive connectors 11 may be respectively disposed on two surfaces of the hexahedron, the two surfaces may be two opposite surfaces or two adjacent surfaces. In some embodiments, the ports of the first ends of the two first conductive connectors 11 may be also disposed at a same end of the terminal body 14 (as shown in FIG. 1(*b*)). For example, the ports of the first ends of the two first conductive connectors 11 may be disposed on a same surface of the terminal body 14. In some embodiments, each of the at least one impedance branch circuit may include one impedance element 13. In other embodiments, each of the at least one impedance branch circuit may include a plurality of impedance elements 13, and the plurality of impedance elements may be connected in series or in parallel.

In some embodiments, the one or more impedance elements 13 may include a capacitor, and a capacitance of the one or more impedance elements 13, i.e. a capacitance of the impedance branch circuit may range from 33 pF to 63 nF. Specifically, the capacitance of the impedance branch circuit that is connected in a lighting circuit may range from 33 pF to 470 pF, or range from 470 pF to 6.3 nF, or range from 6.3 nF to 63 nF. In other embodiments, the one or more impedance elements 13 may include a resistor or an inductor.

In some embodiments, the connection terminal 10 may include a plurality of impedance branch circuits (as shown in FIGS. 1(*c*), (*d*), (*e*) and (*f*). Impedance of the one or more impedance elements 13 included in each impedance branch circuit may be the same or different. When the connection terminal 10 includes a plurality of impedance branch circuits, different impedance branch circuits may be connected with each other at one or more points (as shown in FIGS. 1(*c*) and (*e*)); or different impedance branch circuits may be independent from each other, that is, there is no connection point between any two impedance branch circuits (as shown in FIGS. 1(*d*) and (*f*)).

In the embodiments shown in FIG. 1, since one or more impedance elements 13 are connected between any two first conductive connectors 11, the connection terminal 10 may be connected to a circuit through any two first conductive connectors 11, or through multiple groups of first conductive connectors, with each group of first conductive connectors including two first conductive connectors 11.

Figure 2:
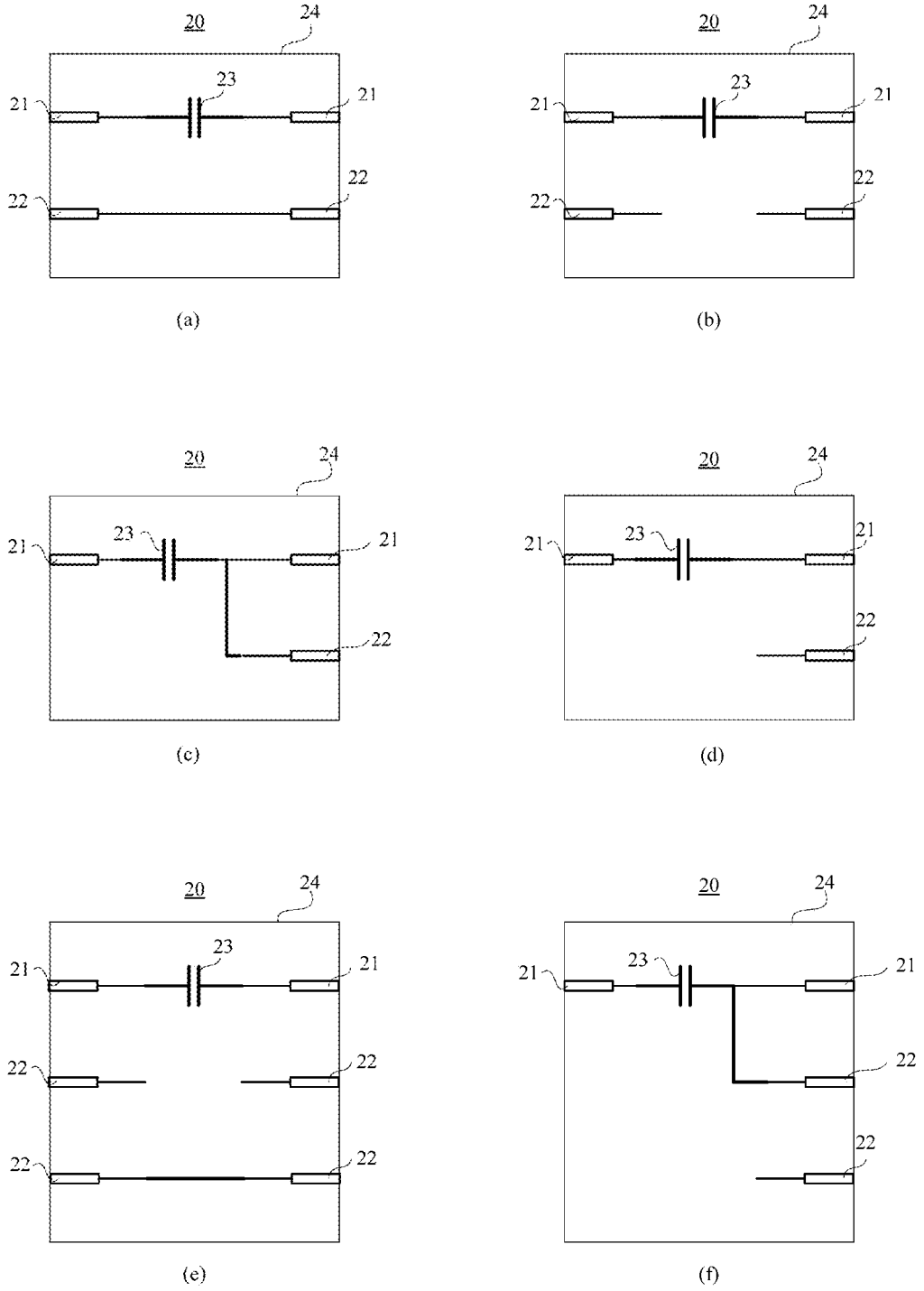
FIG. 2 schematically illustrates structural diagrams of connection terminals 20 according to another embodiment of the present disclosure.

Referring to FIG. 2, FIG. 2 schematically illustrates structural diagrams of connection terminals 20 according to another embodiment of the present disclosure. A main difference between this embodiment and the embodiment shown in FIG. 1 lies in that, the connection terminal 20 includes not only at least two first conductive connectors 21 but also includes a second conductive connector 22, FIGS. 2(*a*)-(*f*) show structures of several connection terminals 20 including at least one second conductive connector 22.

As shown in FIGS. 2(*a*), (*b*), (*e*), in some embodiments, the connection terminal 20 may include a plurality of second conductive connectors 22, a first end of each of the plurality of second conductive connectors 22 may be configured to be connected with a wire, and second ends of every two second conductive connectors 22 may be disconnected or shorted with each other. When the connection terminal 20 is connected to a circuit through two first conductive connectors 21, current of the circuit can be adjusted; when the connection terminal 20 is connected to a circuit through two second conductive connectors 22, the circuit may be turned on or turned off. In these embodiments, the second conductive connector 22 may be disconnected with the first conductive connector 21. In some embodiments, the first ends of each group of second conductive connectors 22 may be configured to be connected with a driving power supply and an illumination lamp, respectively, where the each group second conductive connectors 22 includes two second conductive connectors 22.

As shown in FIGS. 2(*c*), (*d*) and (*f*), in some embodiments, the connection terminal 20 may include at least one second conductive connector 22, a first end of each of the at least one second conductive connector 22 may be configured to be connected with a wire, and a second end of the second conductive connector 22 may be disconnected or shorted with the second end of the first conductive connector 21. When the connection terminal 20 is connected to a circuit through two first conductive connectors 21, current of the circuit may be adjusted; when the connection terminal 20 is connected to a circuit through a first conductive connector 21 and a second conductive connector 22, the circuit may be turned on or turned off, and the first end of the first conductive connector 21 and the first end of the second conductive connector 22 may be connected with a driving power supply and an illumination lamp respectively, or may be connected with an illumination lamp and a driving power supply respectively.

In some embodiments, the second conductive connector 22 may be disposed inside the terminal body 24, and the first end of the second conductive connector 22 may be provided with a port (not shown) exposed outside the terminal body 24 so as to be connected with a wire.

In some embodiments, a port of the first end of the first conductive connector 21 and a port of the first end of the second conductive connector 22 may be configured in a specific structure so that a wire can be safely and fast inserted into the ports. For example, a spring may be disposed in the port to clamp a wire.

Figure 3:
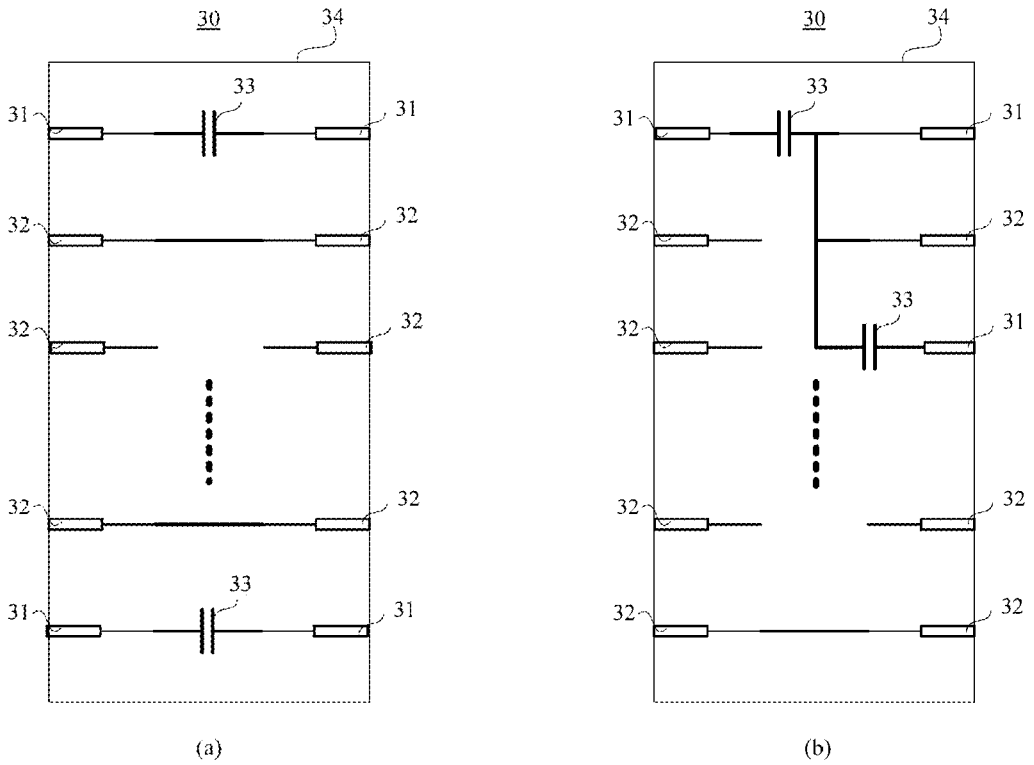
FIG. 3 schematically illustrates structural diagrams of connection terminals 30 according to another embodiment of the present disclosure.

FIGS. 2(*a*) to (*f*) illustrate structures of several connection terminals including two or three groups of conductive connectors. However, embodiments of the present disclosure are not limited hereto. Referring to FIG. 3, FIG. 3 schematically illustrates structural diagrams of connection terminals 30 according to another embodiment of the present disclosure. In some embodiments, the connection terminal 30 may include three or more groups of conductive connectors. Each group of conductive connectors (i.e. two conductive connectors) forms a connection way, and each of the two conductive connectors may be a first conductive connector 31, or one of the two conductive connectors may be a first conductive connector 31, and the other of the two conductive connectors may be a second conductive connector 32. Different functions can be achieved when the connection terminals 30 is connected to a circuit via different types of conductive connectors. The connection terminal 30 in the present disclosure may include at least one impedance branch circuit and may be applied to a lighting circuit, a first conductive connector 31 of the at least one impedance branch circuit of the connection terminal 30 may be connected with a driving power supply, and the other first conductive connector 31 of the at least one impedance branch circuit may be connected with an illumination lamp, input ends of the driving power supply may be configured to be connected to an AC power grid, output ends of the driving power supply may be configured to output an alternating current power, and the illumination lamp may be configured to be driven by an alternating current power. In some embodiments, output ends of the driving power supply may be configured to output a high frequency alternating current power, and the illumination lamp may be configured to be driven by a high frequency alternating current power. Specifically, the high frequency alternating current power may have a frequency greater than 20 KHz.

The connection terminal 30 according to embodiments may include a variety of conductive connectors. In practical applications, the number and types of conductive connectors in the connection terminal 30 may be flexibly selected according to circuit requirements, thereby increasing integration of the connection terminal 30.

The driving power supply to which the connection terminals according to the above embodiments are coupled may be LED ballasts. The illumination lamp to which the connection terminals according to the above embodiments are coupled may be an LED lamp. In some embodiments, the LED lamp may be an LED strip lamp, an LED horticultural lamp, an LED tube lamp, an LED panel lamp, an LED wallpaper or an LED backlight, and the LED tube lamp may include a double-end or single-end LED tube lamp.

Figure 4:
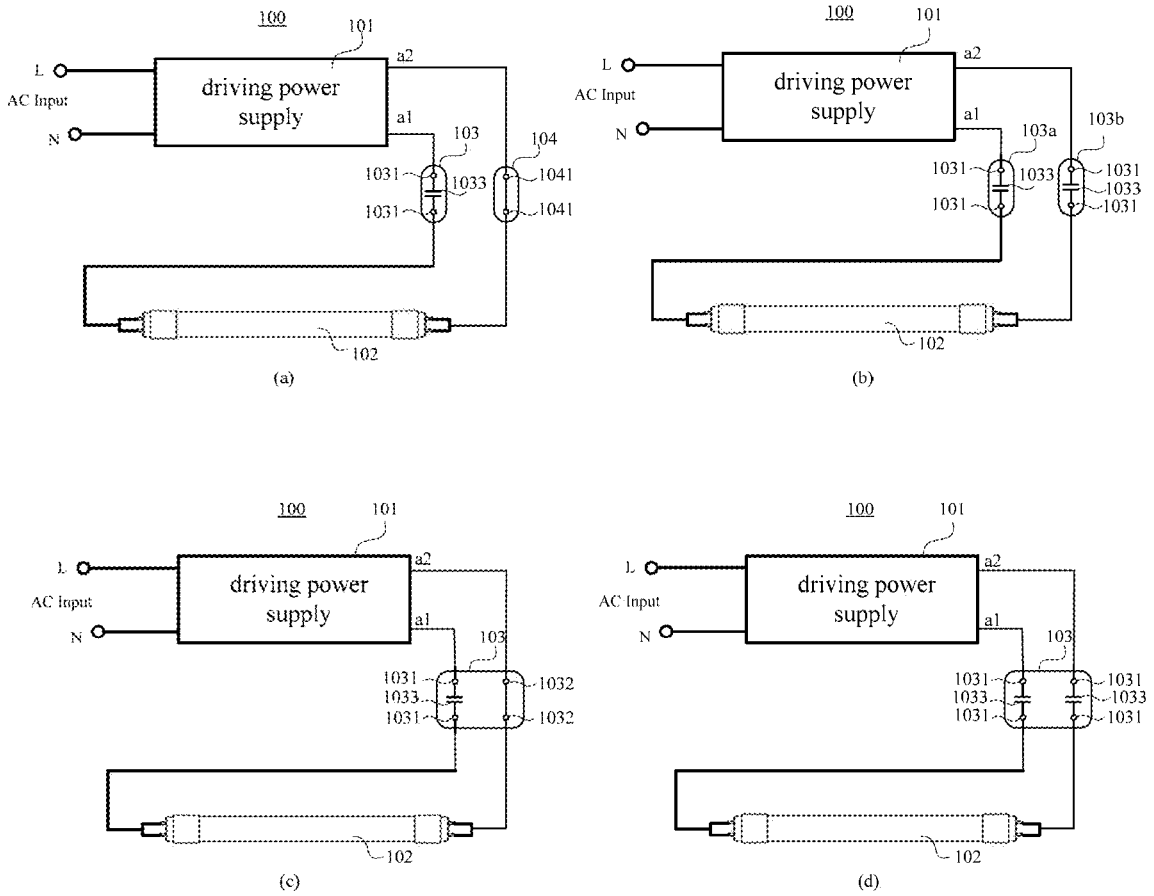
FIG. 4 schematically illustrates structural diagrams of illumination devices 100 according to an embodiment of the present disclosure.

An illumination device is also provided according to embodiments of the present disclosure. Referring to FIG. 4, FIG. 4 schematically illustrates structural diagrams of illumination devices 100 according to an embodiment. In some embodiments, the illumination device 100 may include a driving power supply 101, an illumination lamp 102, and a connection terminal 103 according to the aforementioned embodiments. Input ends of the driving power supply 101 may be configured to be connected with an AC power grid, output ends of the driving power supply 101 may be coupled with two ends of the illumination lamp 102 to form a driving circuit, and two first conductive connectors of at least one impedance branch circuit of the connection terminal 103 are connected to the driving circuit.

In some embodiments, the driving power supply 101 may include an LED ballast. The LED ballast belongs to an LED driving power supply, and refers to a power converter made by using an electronic technology and configured to drive an LED lamp, so that the LED lamp can produce a desired illumination. The LED driving power supply in existing technology is configured to convert utility frequency alternating current of a power grid into a specific direct current to drive an LED load. Differently, the LED ballast in the present disclosure is configured to convert utility frequency alternating current into high frequency alternating current, so as to drive an alternating current LED lamp to work. In some embodiments, the high frequency alternating current power output by the LED ballast may have a frequency higher than 20 KHz.

In some embodiments, the illuminating lamp 102 may be an LED lamp, and the LED lamp may be configured to be driven by a high frequency alternating current power supply. The LED lamp may have a same structure as a conventional fluorescent lamp, so that the LED lamp can be directly installed on a lamp socket interface of a conventional fluorescent lamp, which makes better use of existing resources and reduces cost of upgrading the LED illumination device.

As shown in FIG. 4(*a*), in some embodiments, the illumination device 100 may include one connection terminal

103, the one connection terminal 103 may include an impedance branch circuit, and the impedance branch circuit may include two first conductive connectors 1031 and one or more impedance elements 1033 connected between the two first conductive connectors 1031. The illumination device 100 may further include a terminal 104 applied for electrical connection only, the terminal 104 may include two conductive connectors 1041, and the two conductive connectors 1041 may be short-circuited. The connection terminal 103 is connected in series between a first output end a1 of the driving power supply 101 and a first end of the illumination lamp 102, which can adjust an operating current of the illumination lamp 102. The second terminal 104 is connected in series between a second output end a2 of the driving power supply 101 and a second end of the illumination lamp 102, which only realizes an electrical connection.

In other embodiments, a first conductive connector 1031 of the connection terminal 103 may be coupled with a first end of the illumination lamp 102, and another first conductive connector 1031 of the connection terminal 103 may be coupled with a second end of the illuminating lamp 102, so that the one or more impedance elements 1033 of the connection terminal 103 may be connected in parallel with the illuminating lamp 102, which can also realize adjustment of an operating current of the illuminating lamp 102.

As shown in FIG. 4(*b*), in some embodiments, the illumination device 100 may include two connection terminals 103*a* and 103*b*, each of which may include one impedance branch circuit, the one impedance branch may include two first conductive connectors 1031 and one or more impedance elements 1033 connected between the two first conductive connectors 1031. The connection terminal 103*a* may be connected in series between a first output end a1 of the driving power supply 101 and a first end of the illumination lamp 102, and the connection terminal 103*b* may be connected in series between a second output end a2 of the driving power supply 101 and a second end of the illumination lamp 102. The operating current of the illumination lamp 102 may be adjusted by connecting two connection terminals 103*a* and 103*b* in the driving circuit.

As shown in FIG. 4(*c*), in some embodiments, the illumination device 100 may include a connection terminal 103, the connection terminal 103 may include one impedance branch circuit, and the one impedance branch circuit may be connected in series between a first output end a1 of the driving power supply 101 and a first end of the illumination lamp 102. The connection terminal 103 may further include two second conductive connectors 1032, second ends of the two second conductive connectors 1032 may be shorted, and first ends of the two second conductive contacts 1032 may be respectively coupled with a second output end a2 of the driving power supply 101 and a second end of the illumination lamp 102.

It should be noted that, although each of the connection terminals 103 of the illumination devices 100 shown in FIGS. 4(*a*), (*b*) and (*c*) includes only one impedance branch circuit, embodiments of the present disclosure are not limited thereto, and each connection terminal 103 of the illumination device 100 may include a plurality of impedance branch circuits.

Referring to FIG. 4(*d*), in some embodiments, the illumination device 100 may include a connection terminal 103, and the connection terminal 103 may include two impedance branch circuits. One or more impedance elements 1033 of one of the two impedance branch circuits may be connected in series between a first output end a1 of the power supply 101 and a first end of the illumination lamp 102, and one or more impedance elements 1033 of the other of the two impedance branch circuits may be connected in series between a second output end a2 of the driving power supply 101 and a second end of the illumination lamp 102.

As described above, the illumination lamp 102 may be an alternating current LED lamp. In some embodiments, the illumination lamp 102 may include a light emitting element and an AC-DC (Alternating Current to Direct Current) conversion circuit, input ends of the AC-DC conversion circuit may be coupled with output ends of the driving power supply 101, output ends of the AC-DC conversion circuit may be coupled with two ends of the light emitting element, and the AC-DC conversion circuit may be configured to convert an AC power into a DC power. In some embodiments, the illumination lamp 102 may include one or more light emitting elements.

Figure 5:
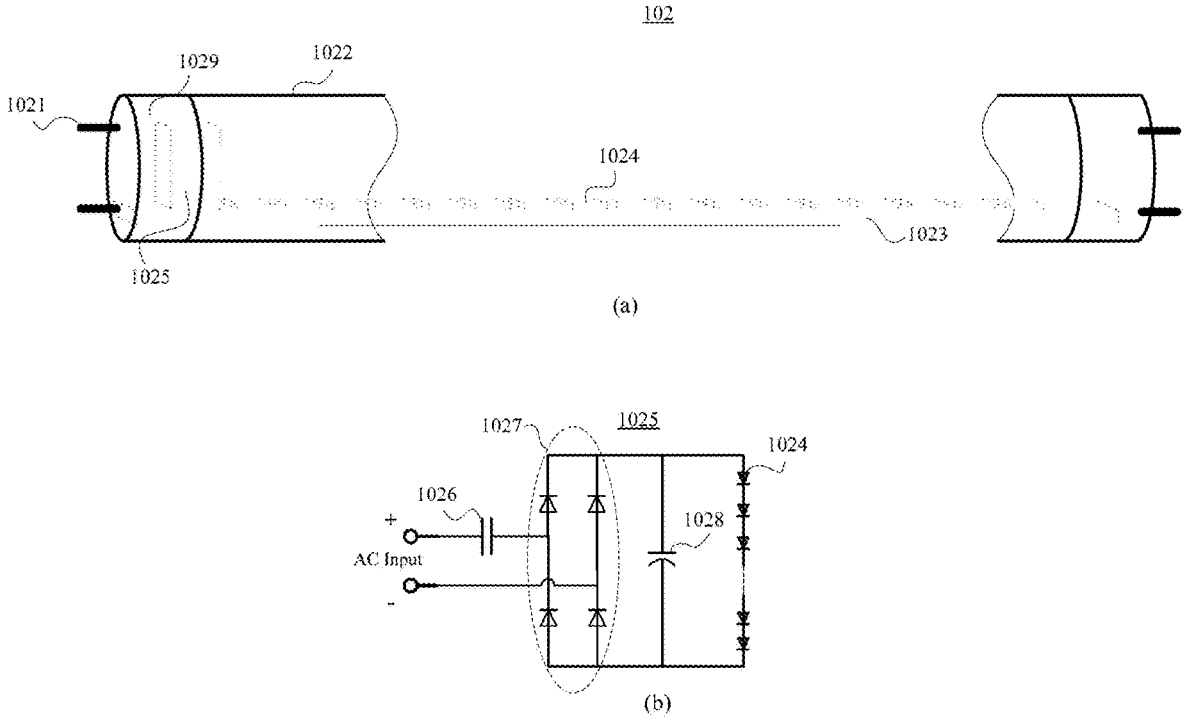
FIG. 5 schematically illustrates a structural diagram of an illumination lamp 102 of the illumination devices 100 according to the embodiments shown in FIG. 4.

Referring to FIG. 5, FIG. 5 schematically illustrates a structural diagram of the illumination lamp 102 according to the embodiments shown in FIG. 4. FIG. 5(*a*) shows an internal structure of the illumination lamp 102, and FIG. 5(*b*) shows a structure of the AC-DC conversion circuit 1025 of the illumination lamp 102.

As shown in FIG. 5(*a*), in some embodiments, the illumination lamp 102 may further include lamp pins 1021, a lamp tube 1022 and a lamp bar 1023. The lamp bar 1023 may be disposed inside the lamp tube 1022, and a plurality of light emitting elements 1024 may be disposed on the lamp bar 1023. One end of each lamp pin 1021 may be configured to be coupled to a driving power supply through a connection terminal, and the other end of the each lamp pin 1021 may be coupled to an input end of AC-DC conversion circuit 1025. Output ends of the AC-DC conversion circuit 1025 may be coupled with the lamp bar 1023, and the lamp bar 1023 may be coupled with the one or more light emitting elements 1024. The AC-DC conversion circuit 1025 may be configured to convert high frequency alternating current power outputted by the driving power supply into stable direct current power, and to provide the direct current power to the lamp bar 1023 so as to drive the one or more light emitting elements 1024 to emit light.

In some embodiments, the one or more light emitting elements 1024 may be one or more light emitting diodes (LEDs).

In some embodiments, the AC-DC conversion circuit 1025 may be disposed inside the lamp tube 1022 and disposed at one end or both ends of the lamp bar 1023.

In some embodiments, the illuminating lamp 102 may further include lamp caps 1029 disposed at both ends of the amp tube 1022 and detachably connected to the lamp tube 1022. The AC-DC conversion circuit 1025 may be disposed inside the lamp cap 1029.

In some embodiments, the lamp tube 1022 may be a double-ended lamp tube, that is, the lamp caps 1029 of the lamp tube 1022 may be disposed at two ends of the lamp tube 1022. The double-ended lamp tube may include a straight lamp tube.

In other embodiments, the lamp tube 1022 may be a single-ended lamp tube, that is, the lamp caps 1029 of the lamp tube 1022 may be disposed at one end of the lamp tube 1022, and the single-ended lamp tube 1022 may include a U-shaped, a ring-shaped, an H-shaped, a double U-shaped, a square-shaped, a ball shaped or a spiral-shaped lamp tube.

As shown in FIG. 5(*b*), in some embodiments, the AC-DC conversion circuit 1025 may include a first capacitor 1026 configured to block DC or block utility frequency power for mis-use safety; a rectifier module 1027 configured to convert alternating current into direct current; and a second capacitor 1028, configured to filtering. In some embodiments, the rectifier module 1027 may be configured to convert high frequency alternating current into direct current.

The AC-DC conversion circuit 1025 may include two input ends configured to be input with AC power, and the AC-DC conversion circuit 1025 may further include two output ends coupled with both ends of the one or more light emitting elements 1024 respectively. The first capacitor 1026 is connected in series between an input end of the AC-DC conversion circuit 1025 and an input end of the rectifier module 1027. Two input ends of the rectifier module 1027 are coupled with input ends of the AC-DC conversion circuit respectively, and two output ends of the rectifying module 1027 are respectively coupled with two ends of the second capacitor 1028. The two ends of the second capacitor 1028 serve as two output ends of the AC-DC conversion circuit 1025 and are respectively coupled with both ends of the one or more light emitting elements 1024.

In some embodiments, the rectifier module 1027 may include a full bridge rectifier circuit comprised of four diodes.

Figure 6:
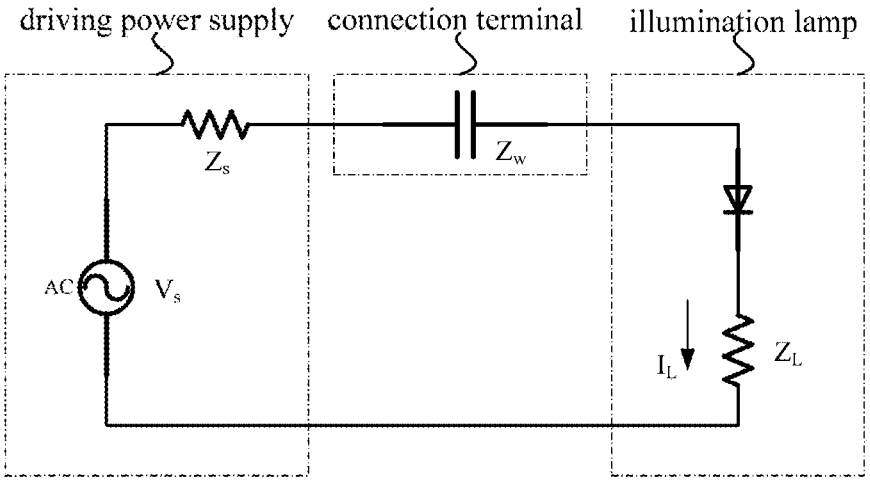
FIG. 6 schematically illustrates an equivalent circuit diagram of a driving circuit of the illumination devices 100 according to the embodiments shown in FIG. 4.

Referring to FIG. 6, with reference to FIG. 4, FIG. 6 schematically illustrates an equivalent circuit diagram of a driving circuit of the illumination device 100 according to the embodiment shown in FIG. 4.

Different from a conventional LED driving power supply, the driving power supply 101 according to embodiments of the present disclosure is configured to output a high-frequency alternating current power, and is applied to drive the illumination lamp 102 with a built-in AC-DC conversion circuit through the connection terminal 103. In FIG. 6, $V_s$ is an equivalent output voltage of the driving power supply 101, $Z_s$ is an equivalent output impedance of the driving power supply 101, $Z_w$ is an equivalent impedance of the at least one impedance branch circuit of the connection terminal 103, $C_w$ is an equivalent capacitance of the at least one impedance branch circuit of the connection terminal 103, $\omega=2\pi f$, where f is an output operating frequency of the driving power supply 101, and $Z_L$ is an equivalent load impedance of the illumination lamp 102, then a load current $I_L$ of the illumination lamp 102 is:

$$I_L = \frac{V_S}{Z_s + Z_w + Z_L}, \text{ wherein, } Z_w = 1/(j\omega C_W).$$

As can be seen from the above formula, when parameters of the driving power supply 101 and the illumination lamp 102 are unchanged, the load current $I_L$ of the illumination lamp 102 can be adjusted by connecting connection terminals 103 with different capacitance $C_W$ in the driving circuit, thereby further adjusting a lumen output of the illumination lamp 102. Normally, $Z_s$ is much larger than $Z_L$, thus the operating current of the illumination lamp 102 can be significantly adjusted by changing $Z_w$, when $Z_w$ is much larger than $Z_L$ and is comparable or close to Zs, or when $Z_w$ is much larger than $Z_s$.

In some embodiments, the impedance of the one or more impedance elements 1033 of the connection terminal 103 may be determined based on an output lumen of the illumination lamp 102 (or an operating current $I_L$), an output voltage $V_S$ of the driving power supply 101 and an equivalent output impedance $Z_s$ of the driving power supply 10. When the one or more impedance elements 1033 include a capacitor, the capacitance of the capacitor may be determined according to an output lumen of the illumination lamp 102 (or an operating current $I_L$), an output voltage $V_S$ of the driving power supply 101, an equivalent output impedance $Z_s$ of the driving power supply 101, and an output operating frequency f of the driving power supply 101.

Since the conventional LED driving power supply is configured to output DC, its voltage/current specifications must be matched with the LED lamps. Different environments may have different requirements for illuminance of LED lamps, thus LED lamps of different specifications and driving power supplies of different parameters matched with the LED lamps are required. It normally requires professional technology of engineers to use a programming or a program setting method to change output specification parameters of a programmable driving power supply, so as to match the driving power supply with different LED lamps, which is not easy to operate and does not meet on-site operation habits of lamp assembling and retrofitting staffs, and is thus inconvenient for large-scale promotion.

In embodiments of the present disclosure, it is not an LED driving power supply with DC output but an LED driving power supply with a high frequency AC output that is used to drive the LED lamp. A high frequency coupling capacitor is connected in the driving circuit, and the AC LED lamp includes a built-in AC-DC conversion circuit, which can rectify a coupled high-frequency alternating current into a direct current and output the direct current to the LED lamp bar to light the one or more LED light-emitting elements. Connection terminals of different specifications may have built-in capacitors of different capacitances. Connecting connection terminals of different specifications is equivalent to changing the capacitance of the capacitor connected to the driving circuit, thereby changing a load current and a lumen output of the LED lamp, and finally setting illuminance of the LED lamp.

Since the connection terminal that does not include an impedance element is a common component in a retrofitting and assembling process of lamps, it is not necessary for a staff to master complicated programming skills to connect the connection terminal in a circuit, and the connection terminal conforms to on-site operation habits of staffs which is suitable for large-scale promotion. By configuring connection terminals of various specifications, it is possible to avoid preparation of a large number of LED lamps and driving power supplies of different specifications, parameters and models, which greatly reduces production cost and inventory management difficulty of manufacturers.

It should be noted that, the impedance element 1033 of the connection terminal 103 according to embodiments of the present disclosure may include an inductor or a resistor in addition to a capacitor, which can also change an operating current of the illumination lamp 102. However, connecting a resistor in the driving circuit will add extra power loss, and the system efficiency will be reduced compared with using a capacitor. Although connecting an inductor in the driving circuit will not increase the power loss, due to a large size and a high cost of the inductor, using a capacitor as the impedance element 1033 is still superior to using an inductor.

In embodiments of FIG. 4, an illumination device including one illumination lamp is taken as an example for illustrating structures of connection terminals of the illumination device and connection ways of the connection terminals in the lighting circuit. However, embodiments of the present disclosure are not limited thereto. In the following, structures of connection terminals and their connection ways in a lighting circuit are further described by taking an illumination device including a plurality of illumination lamps as an example.

Figure 7:
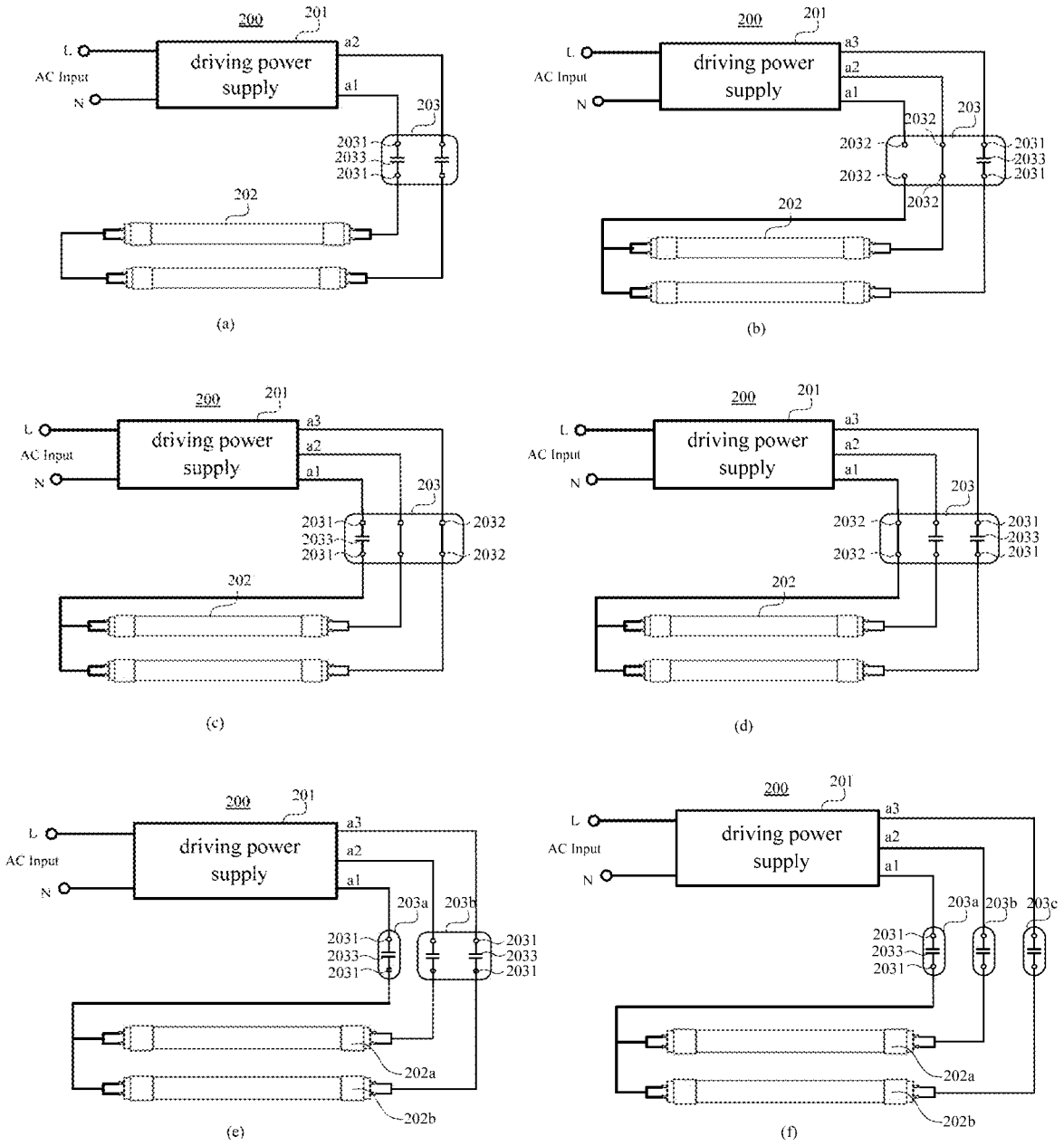
FIG. 7 schematically illustrates structural diagrams of illumination devices 200 according to another embodiment of the present disclosure.

Referring to FIG. 7, FIG. 7 schematically illustrates structural diagrams of illumination devices 200 according to another embodiment of the present disclosure. In some embodiments, the illumination device 200 may include a driving power supply 201, two illumination lamps 202 and one or more connection terminals 203. This embodiment may be applied to an illumination system including two lamps.

As shown in FIGS. 7(*a*) and 7(*b*), in some embodiments, the two illumination lamps 202 may be connected in series in a driving circuit, and the illumination device 200 may include one connection terminal 203, and at least one impedance branch circuit of the one connection terminal 203 may be connected to the driving circuit. In other embodiments, a plurality of connection terminals may be connected to the driving circuit of the two illumination lamps connected in series, and at least one impedance branch circuit of the plurality of connection terminals may be connected to the driving circuit.

As shown in FIGS. 7(*c*), (*d*), (*e*) and (*f*), in some embodiments, the two illumination lamps 202 may be connected in different driving circuits. Specifically, the driving power supply 201 may include at least two groups of output ends (a1, a2) and (a1, a3), and two ends of the two illumination lamps 202 are respectively coupled with the two groups of output ends (a1, a2) and (a1, a3) of the driving power supply 201 so as to form two driving circuits.

In some embodiments, the driving power supply 201 may include a common output end a1, each group of output terminals of the driving power supply 201 may include the common output end a1, and first ends of the two illumination lamps 202 are both connected to the common output end a1.

As shown in FIG. 7(*c*), in some embodiments, the illumination device 200 may include one connection terminal 203, and the one connection terminal 203 may include one impedance branch circuit, the one impedance branch circuit may be connected in series between the common output end a1 of the ballast driving power supply 201 and first ends of the two illumination lamps 202 to adjust operating currents of the two illumination lamps 202 simultaneously. The one connection terminal 203 may further include two groups of second conductive connectors 2032, with each group including two second conductive connectors 2032, and the two second conductive connectors of each group may be shorted. The two groups of second conductive connectors 2032 may be respectively used to electrically connect second ends of the two illumination lamps 202 with the two output ends a2 and a3 of the ballast driving power supply 201.

As shown in FIG. 7(*d*), in some embodiments, the illumination device 200 may include one connection terminal 203, and the one connection terminal 203 may include two impedance branch circuits. The two impedance branch circuits may be respectively connected in series between the second ends of the two illumination lamps 202 and the two output ends a2 and a3 of the driving power supply 201. The one connection terminal 203 may further include two second conductive connectors 2032, and second ends of the two second conductive connectors 2032 are short-circuited, so as to electrically connect the common output a1 of the driving power supply 201 to the first ends of the two illumination lamps 202.

As shown in FIG. 7(*e*), in some embodiments, the illumination device 200 may include two connection terminals 203*a* and 203*b*, a first connection terminal 203*a* may include an impedance branch circuit, and a second connection terminal 203*b* may include two impedance branch circuits. The first connection terminal 203*a* may be connected in series between the common output end a1 of the driving power supply 201 and first ends of the two illumination lamps 202*a* and 202*b*. An impedance branch circuit of the second connection terminal 203*b* may be connected between a second end of the illumination lamp 202*a* and an output end a2 of the driving power supply 201. Another impedance branch of connection terminal 203*b* may be connected in series between a second end of the illumination lamp 202*b* and an output end a3 of the driving power supply 201, so that there are two impedance branch circuits connected in series in the drive circuit of each illumination lamp.

As shown in FIG. 7(*f*), in some embodiments, the illumination device 200 may include three connection terminals 203*a*, 203*b* and 203*c*, each of which may include one impedance branch circuit. A first connection terminal 203*a* and a second connection terminal 203*b* may be connected to a driving circuit of a first illumination lamp 202*a*, and the first connection terminal 203*a* and a third connection terminal 203*c* may be connected to the driving circuit of a second illumination lamp 202*b*.

Figure 8:
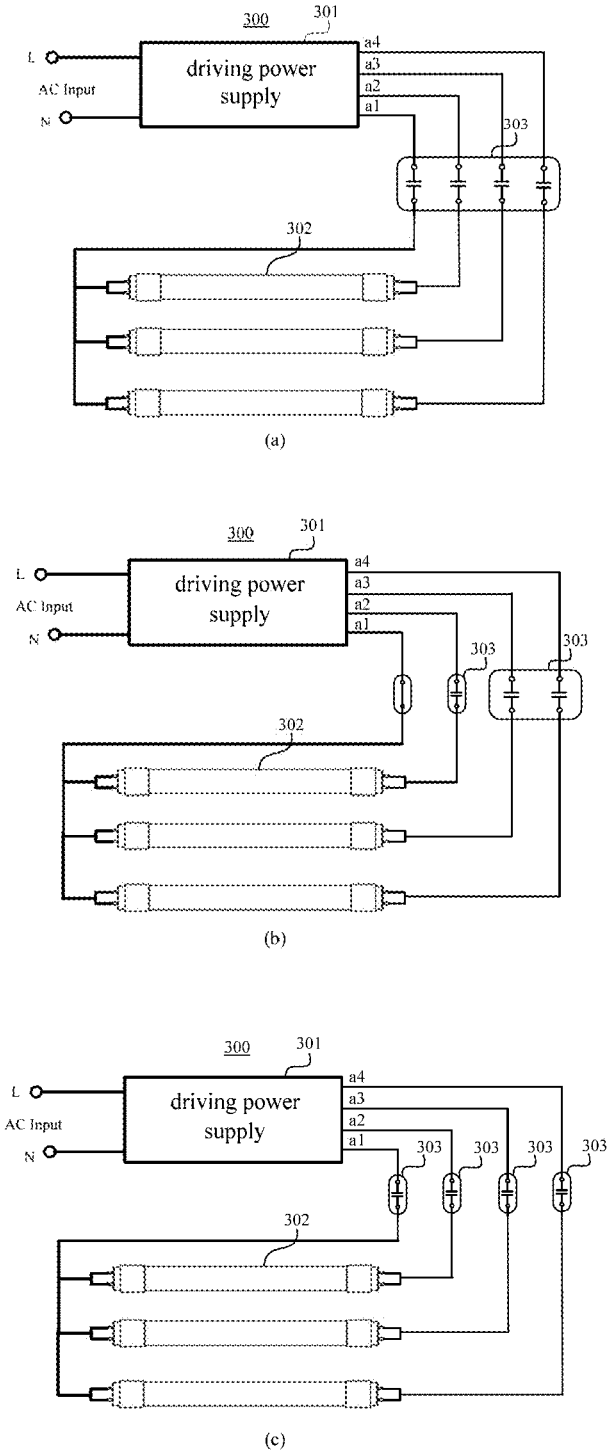
FIG. 8 schematically illustrates structural diagrams of illumination devices 300 according to another embodiment of the present disclosure.

Referring to FIG. 8, FIG. 8 schematically illustrates structural diagrams of illumination devices 300 according to another embodiment of the present disclosure. In some embodiments, the illumination device 300 may include a driving power supply 301, three illumination lamps 302, and one or more connection terminals 303. This embodiment may be applied to an illumination system including three lamps.

Similar to the embodiments shown in FIG. 7, the driving power supply 301 may include a plurality of groups of output ends, and two ends of each illumination lamp 302 may be coupled with one group of output ends to form a driving circuit. Different illumination lamps 302 may be connected in different driving circuits. The plurality of groups of output ends may share a common end a1.

As shown in FIG. 8(*a*), in some embodiments, the illumination device 300 may include one connection terminal 303, and the one connection terminal 303 may include four impedance branch circuits. The four impedance branch circuits of the one connection terminal 303 may be respectively connected to driving circuits of the three illumination lamps 302.

As shown in FIGS. 8(*b*) and (*c*), the illumination device 300 may include a plurality of connection terminals 303, and each connection terminal 303 may include one or more impedance branch circuits. A plurality of impedance branch circuits of the plurality of connection terminals 303 may be respectively connected to driving circuits of the three illumination lamps 302.

Figure 9:
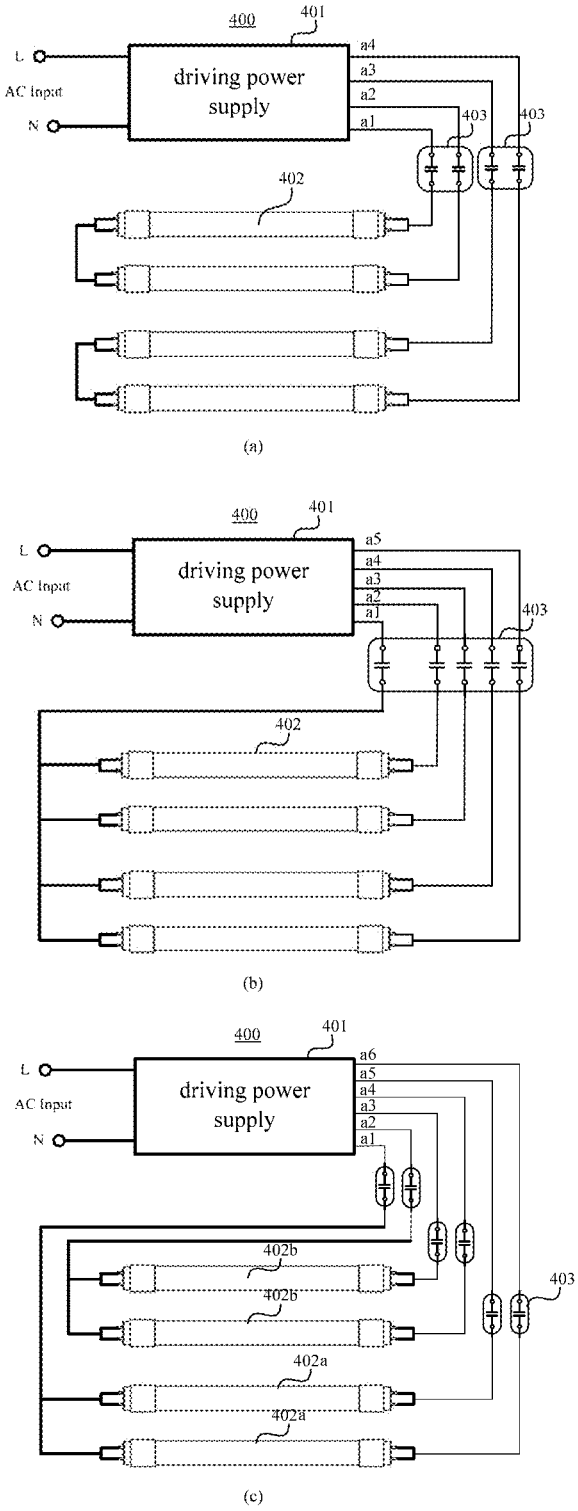
FIG. 9 schematically illustrates structural diagrams of illumination devices 400 according to another embodiment of the present disclosure.

Referring to FIG. 9, FIG. 9 schematically illustrates structural diagrams of illumination devices 400 according to another embodiment of the present disclosure. The illumination device 400 may include a driving power supply 401, four illumination lamps 402, and one or more connection terminals 403. This embodiment may be applied to an illustration system including four lamps.

As shown in FIG. 9(*a*), in some embodiments, the four illumination lamps 402 may be divided into two groups, and the two groups of illumination lamps 402 may be respectively coupled to two groups of output ends of the driving power supply 401 to form two driving circuits. The two illumination lamps 402 of each group may be connected in series in a same driving circuit. The illumination device 400 may include two connection terminals 403 that are respectively connected in the two driving circuits. Each connection terminal 403 may include two impedance branch circuits, and the two impedance branch circuits are both connected in the same driving circuit.

As shown in FIG. 9(*b*), in some embodiments, two ends of the four illumination lamps 402 may be respectively coupled to four groups of output ends of the driving power supply 401 to form four driving circuits. The four groups of output ends of the driving power supply 401 may share a common output end a1, and first ends of the four illumination lamps 402 may be all connected to the common output end a1. The illumination device 400 may include one connection terminal 403. The one connection terminal 403 may include five impedance branch circuits, and the five impedance branch circuits may be respectively connected in driving circuits of the four illumination lamps 402. In other embodiments, the one connection terminal may include four impedance branch circuits, and the four impedance branch circuits may respectively connected in the driving circuits of the four illumination lamps. In other embodiments, the one connection terminal may include one impedance branch circuit, and the one impedance branch circuit may be connected in series between the common output end a1 of the driving power supply 401 and first ends of the four illumination lamps 402.

As shown in FIG. 9(*c*), in some embodiments, the driving power supply 401 may include two common output ends a1 and a2, and the four illumination lamps 402 may be divided into two groups, with each group including two illumination lamps. First ends of a first group of illumination lamps 402*a* may be coupled to the first common output end a1 of the driving power supply 401, and first ends of a second group of illumination lamps 402*b* may be coupled to the second common output end a2 of the driving power supply 401. Second ends of the four illumination lamps may be respectively coupled to other four output ends a3, a4, a5 and a6 of the driving power supply 401, so that the four illumination lamps are respectively connected in four driving circuits. The illumination device 400 may include six connection terminals 403, and each connection terminal 403 may include an impedance branch circuit. Two of the six connection terminals 403 are respectively connected between first ends of the first group of illumination lamps 402*a* and the first common output end a1 of the driving power supply 401, and between first ends of the second group of illumination lamps 402*b* and the second common output end a2 of the driving power supply 401. The rest four connection terminals 403 are respectively connected between second ends of the four illumination lamps and the other four output ends a3, a4, a5 and a6 of the driving power supply 401.

Figure 10:
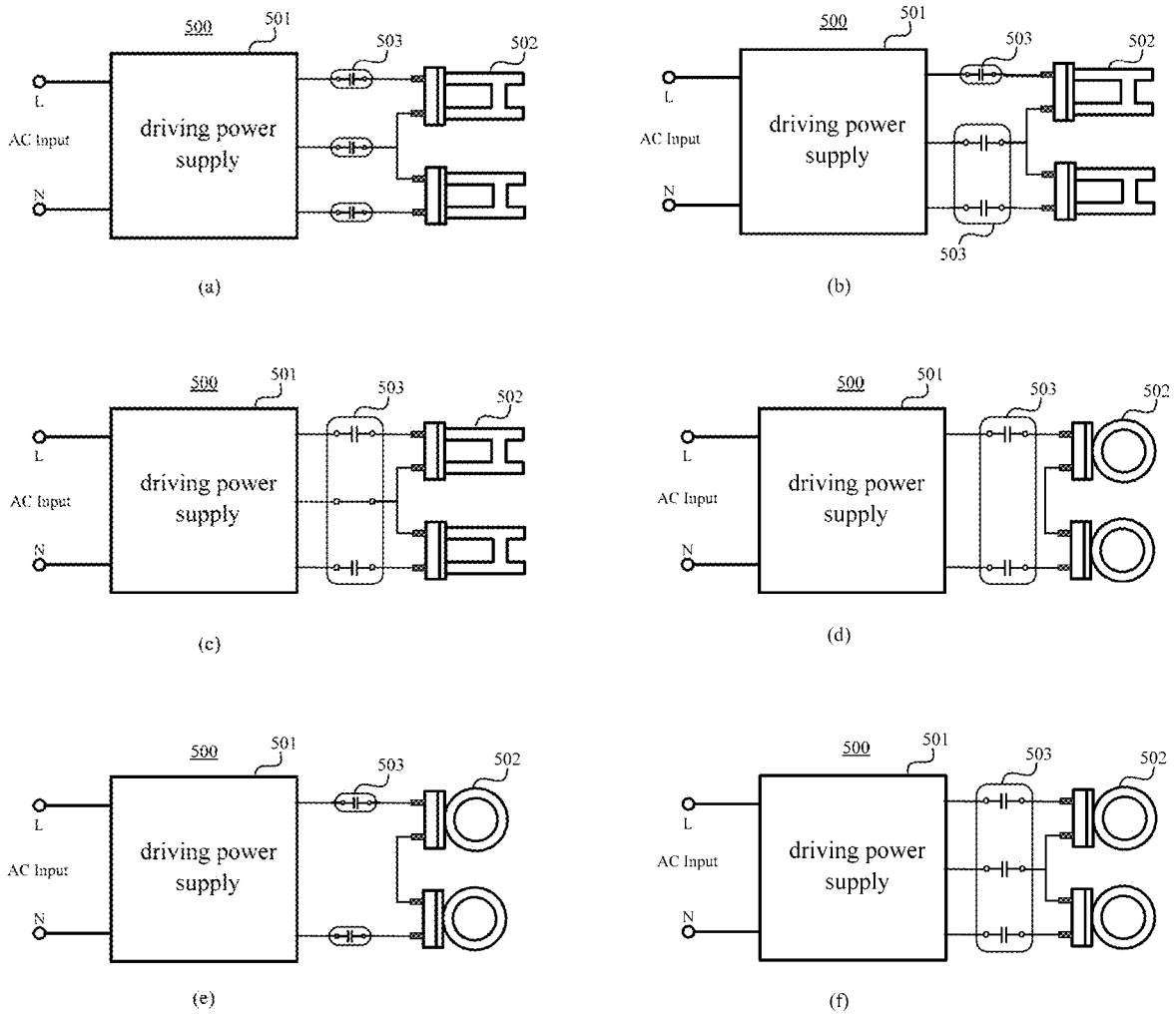
FIG. 10 schematically illustrates structural diagrams of illumination devices 500 according to another embodiment of the present disclosure.

Referring to FIG. 10, FIG. 10 schematically illustrates structural diagrams of illumination devices 500 according to another embodiment of the present disclosure. In some embodiments, the illumination device 500 may include a driving power supply 501, two illumination lamps 502 and one or more connection terminals 503.

The difference between the present embodiment and the foregoing embodiments lies in that, the illumination lamp 502 may include a single-ended lamp tube instead of a double-ended lamp tube, that is, the lamp caps are disposed at a same end of the lamp tube. For example, the single-end lamp tube may be a U-shaped lamp tube (as shown in FIGS. 9(*a*), (*b*) and (*c*)), or a ring-shaped lamp tube (as shown in FIGS. 9(*d*), (*e*) and (*f*)). Regarding the number of connection terminals 503 included in the illumination device 500, the number of impedance branch circuits included in each connection terminal 503, a manner in which the connection terminal 503 is connected in the driving circuit, and a connection manner of the two illumination lamps 502, reference may be made to the foregoing embodiments, which will not be described in detail herein.

In other embodiments, the illuminating lamp 502 may include a single-ended lamp tube of H-shaped, double U-shaped, square-shaped, sphere-shaped or spiral-shaped.

Figure 11:
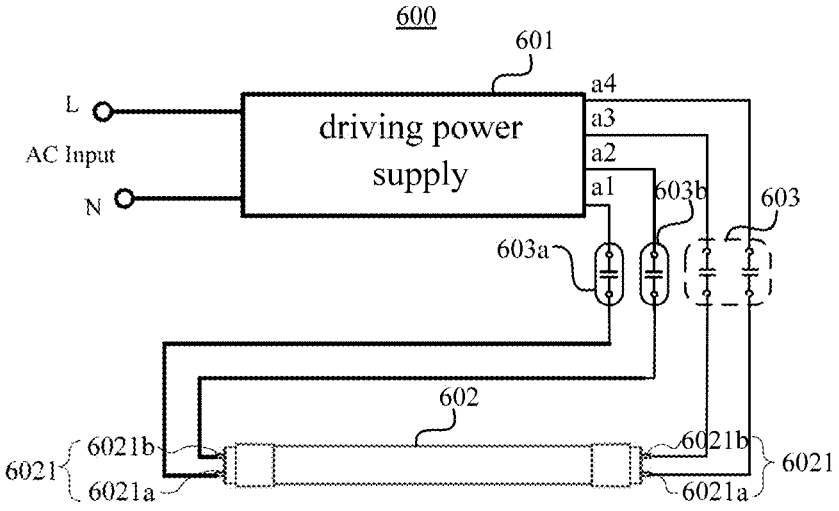
FIG. 11 schematically illustrates a structural diagram of an illumination device 600 according to another embodiment of the present disclosure.

Referring to FIG. 11, FIG. 11 schematically illustrates a structural diagram of an illumination device 600 according to another embodiment of the present disclosure. In some embodiments, the illumination device 600 may include a driving power supply 601, an illumination lamp 602 and two connection terminals 603*a* and 603*b*.

The driving power supply 601 may include two groups of output ends: a first group of output ends (a1, a4) and a second group of output ends (a2, a3). The first group of output terminals (a1, a4) may be respectively connected with two first lamp pins 6021*a* at two ends of the illumination lamp 602, and the second group of output ends (a2, a3) may be respectively connected with two second lamp pins 6021*b* at two ends of the illumination lamp 602.

Figure 12:
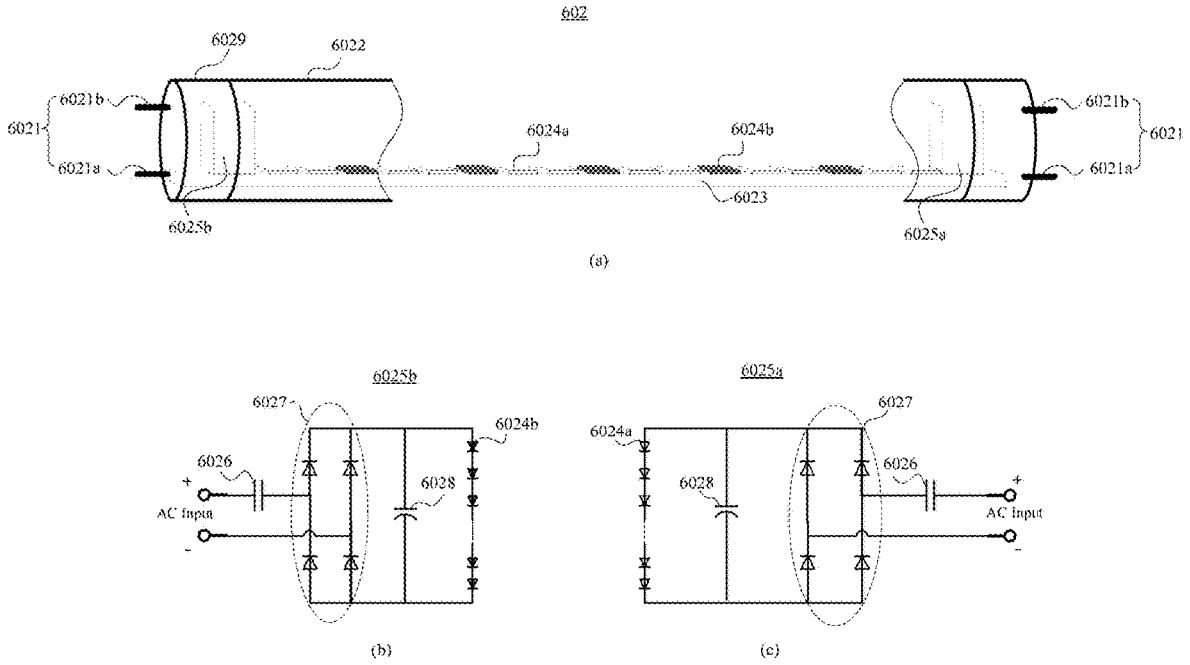
FIG. 12 schematically illustrates a structural diagram of an illumination lamp 602 of the illumination device 600 according to the embodiment shown in FIG. 11.

Referring to FIG. 12, FIG. 12 schematically illustrates a structural diagram of the illumination lamp 602 according to the embodiment shown in FIG. 11. FIG. 12(*a*) shows an internal structure of the illumination lamp 602, and FIGS. 12(*b*) and (*c*) schematically illustrates circuit structures of two AC-DC conversion circuits of the illumination lamp 602. In some embodiments, the illuminating lamp 602 may include lamp pins 6021, lamp caps 6029, lamp tube 6022 and lamp bar 6023. The lamp bar 6023 may be disposed in the lamp tube 6022, and a plurality of light emitting elements may be disposed on the light bar 6023.

Difference between the illuminating lamp 602 in the present embodiment and the illuminating lamps in the foregoing embodiments lies in that, the illuminating lamp 602 may include at least one first light emitting element 6024*a* and at least one second light emitting element 6024*b*, where the first light emitting element 6024*a* and the second light emitting element 6024*b* may have different color temperatures. In some embodiments, the first light emitting element 6024*a* and the second light emitting element 6024*b* may be alternately arranged. The first light emitting element 6024*a* may be configured to emit white light and the second light emitting element 6024*b* may be configured to emit red light. Correspondingly, the lamp pins 6021 may include two first lamp pins 6021*a* respectively disposed at two ends of the lamp tube 6022 and two second lamp pins 6021*b* respectively disposed at two ends of the lamp tube 6022. The two first lamp pins 6021*a* are respectively coupled with the two ends of the first light emitting element 6024*a* through the lamp bar 6023, and the two second lamp pins 6021*b* are respectively coupled with the two ends of the second light emitting element 6024*b* through the lamp bar 6023. In some embodiments, the illuminating lamp 602 may include a plurality of first light emitting elements 6024*a* and a plurality of second light emitting elements 6024*b*.

As shown in FIG. 12(*a*), in some embodiments, the illumination lamp 602 may further include two AC-DC conversion circuits: a first AC-DC conversion circuit 6025*a* and a second AC-DC conversion circuit 6025*b*, the first AC-DC conversion circuit 6025*a* and the second AC-DC conversion circuit 6025*b* may be respectively disposed at two ends of the lamp bar 6023. Referring to FIGS. 12(*b*) and (*c*), FIGS. 12(*b*) and (*c*) respectively show circuit configurations of the second AC-DC conversion circuit 6025*b* and the first DC conversion circuit 6025*a*, where the first AC-DC conversion circuit 6025*a* is configured to convert AC power into DC power, and two input ends of the first AC-DC conversion circuit 6025*a* may be coupled with the two first lamp pins 6021*a* respectively, and thus may be coupled with the first group of output ends (a1, a4) of the driving power supply 601, and two output ends of the first AC-DC conversion circuit 6025*a* may be coupled with the two ends of the first light emitting element 6024*a* through the lamp bar 6023, thereby providing a stable direct current for the first light-emitting element 6024*a* to emit light. The second AC-DC conversion circuit 6025*b* may be configured to convert AC power into DC power, and the two input ends of the second AC-DC conversion circuit 6025*b* may be coupled with the two second lamp pins 6021*b* respectively, and thus to be coupled with the second group of output ends (a2, a3) of the driving power supply 601, and the two output ends of the second AC-DC conversion circuit 6025*b* may be coupled with the two ends of the second light emitting element 6024*b* through the lamp bar 6023, thereby providing a stable direct current power for the second light emitting element 6024*b* to emit light.

With continued reference to FIG. 11, the first group of output ends (a1, a4) of the driving power supply 601 may be coupled with two ends of the first light emitting element 6024*a* through the two first lamp pins 6021*a*, so as to form a first driving circuit. The second group of output ends (a2, a3) of the driving power supply 601 may be coupled with two ends of the second light emitting element 6024*b* through the two second lamp pins 6021*b*, so as to form a second driving circuit.

In some embodiments, the illumination device 600 may include a first connection terminal 603*a* and a second connection terminal 603*b*, the first connection terminal 603*a* and the second connection terminal 603*b* may each include an impedance branch circuit, the impedance branch circuit of the first terminal 603*a* may be connected in the first driving circuit, and the impedance branch circuit of the second terminal 603*b* may be connected in the second driving circuit.

In some embodiments, the illumination device 600 may include only one connection terminal 603 (shown by a dashed box in FIG. 11), and the one connection terminal 603 may include two impedance branch circuits. One impedance branch circuit of the one connection terminal 603 may be connected in the first driving circuit, and the other impedance branch circuit of the one connection terminal 603 may be connected in the second driving circuit.

Since the connection terminals are respectively connected in the driving circuits of the first light emitting element 6024*a* and the second light emitting element 6024*b*, an operating current of the first light emitting element 6024*a* and an operating current of the second light emitting element 6024*b* can be adjusted separately. Further, a lumen output of the first light emitting element 6024*a* and a lumen output of the second light emitting element 6024*b* can be respectively set by connecting connection terminals having specific impedances in the first driving circuit and the second driving circuit respectively, thereby realizing setting of an overall color temperature of the illumination lamp 602.

Color temperatures and a lumen output of the illumination lamp 602 can be set by connecting connection terminals with different impedances in the driving circuits of the illumination lamp, so as to adapt the illumination lamp to different environment which requires different illuminance and light color temperatures. For some environment requiring high illuminance and white light, such as a workplace or an operating table, a connection terminal having a relatively smaller impedance may be connected in series in the driving circuit of the first light emitting element that emits white light, and a connection terminal having a relatively larger impedance may be connected in series in the driving circuit of the second light emitting element that emits red light, so that the illumination lamp 602 can output a mixed light having a high lumen and a color temperature close to white light. For some environments requires low illuminance and soft light, such as a coffee shop or a bedroom, a connection terminal having a relatively larger impedance may be connected in series in a driving circuit of the first light emitting element that emits white light, and a connection terminal having a relatively smaller impedance may be connected in series in a driving circuit of the second light emitting element that emits red light, so that the illumination lamp 602 can output a mixed light of a low lumen and a color temperature close to yellow light.

Connection terminals and illumination devices according to embodiments of the present disclosure may be applied to various LED luminaires, including but not limited to Troffers, High Bay, Low Bay, Pendant, and various embedded luminaires.

The driving power supply in the aforementioned embodiments may be LED ballasts. The illumination lamp in the aforementioned embodiments may be an LED lamp. In some embodiments, the LED lamps may include an LED strip lamp, an LED horticultural lamp, an LED tube lamp, an LED panel lamp, an LED wallpaper or an LED backlight, and the LED tube lamp may include a double-end or single-end LED tube lamp.

In conclusion, the connection terminal according to embodiments of the present disclosure includes at least one impedance branch circuit, wherein each of the at least one impedance branch circuit includes two first conductive connectors and one or more impedance elements connected in series between the two first conductive connectors. Current of a circuit to which the connection terminal is coupled via the two first conductive connectors can be adjusted by the one or more impedance elements. In practical applications, an operating current of a circuit can be set by connecting a connection terminal with a specific impedance to the circuit; and an operating current of a circuit can be adjusting on-site by configuring a plurality of connection terminals with different impedances, and connecting an appropriate one in the circuit. For example, the connection terminal may be applied in assembling and retrofitting of illumination lamps in lighting circuits.

Further, each of the one or more impedance elements may include a capacitor, and when the connection terminal is connected to a circuit, the capacitor will not bring additional power loss to the circuit; and due to the small sizes and low costs of capacitors, using a capacitor as the impedance element of the connection terminal has a great practical value.

Further, the connection terminal may further include at least one second conductive connector, and the at least one second conductive connector may be short-circuited or disconnected with the first conductive connector. When the connection terminal is connected to a circuit through the first conductive connector and the second conductive connector, the circuit will be turned on or turned off; or the connection terminal may further include a plurality of second conductive connectors, the plurality of second conductive connectors may be short-circuited or disconnected with each other, and when the connection terminal is connected to a circuit through two second conductive connectors, the circuit will be turned on or turned off. Therefore, the connection terminal according to embodiments of the present disclosure may include different types of conductive connectors, and different functions can be realized when the connection terminal is connected to a circuit through different types of conductive connectors, thereby improving integration of the connection terminal.

An illumination device is also provided according to embodiments of the present disclosure, including a driving power supply, an illumination lamp, and the aforementioned connection terminal, wherein output ends of the driving power supply are coupled with two ends of the illumination lamp to form a driving circuit, two first conductive connectors of the impedance branch circuit of the connection terminal are connected to the driving circuit to adjust an operating current of the illuminating lamp, thereby adjust a lumen output of the illumination lamp. In practical applications, manufacturers can produce connection terminals of different specifications, the installation or maintenance staff only need to connect electrical wires of the driving power supply and electrical wires of the illumination lamp respectively with the two first conductive connectors of the connection terminal of a specific specification, so as to achieve an on-site adjustment of illuminance of an illumination lamp in a convenient, quick and safe way, which can further meet different illuminance requirements of different environments, and is particularly suitable for large-scale assembling and retrofitting of illumination lamps.

In the illumination device according to embodiments of the present disclosure, an lumen output of the illumination lamp can be adjusted by connecting connection terminals of different specifications, which has the following advantages: firstly, requirements for various specifications of illuminating lamps and various specifications of driving power supplies can be greatly reduced, because only a few specifications of illuminating lamps and driving power supplies with a variety of connection terminals, can easily satisfy a wide range of illumination demands, thereby greatly reducing production cost and inventory management difficulty of manufacturers and suppliers; secondly, due to the low cost and small size of the connection terminal, it is easy to stock, and the adaptation between the illumination lamp and the driving power supply can be flexibly solved; thirdly, compared with using a programmable LED driving power supply, it does not require high professional skills of staffs who assemble illumination lamps on site by using the connection terminal. The connection terminal is easy to operate, thereby promoting application of this new technology.

Further, the one or more impedance elements of the connection terminal may be connected in series with the illumination lamp, so that it is convenient for the connection terminal to be connected to the driving circuit of the illumination lamp, and a precise adjustment of the operating current of the illumination lamp can be realized.

Further, the illumination device may include a plurality of illumination lamps, which may be connected in series in a same driving circuit. Then, operating currents and lumen outputs of the plurality of illumination lamps can be adjusted by connecting at least one impedance branch circuit in the driving circuit. The connection of at least one impedance branch circuit in the driving circuit can be achieved by connecting one or more connection terminals in the driving circuit.

Further, the illumination device may include a plurality of illumination lamps, which may be respectively connected in a plurality of driving circuits. In this case, a separate impedance branch circuit needs to be connected in each driving circuit to realize an adjustment of an operating current of each illumination lamp. Connection of the impedance branch circuit in each driving circuit can be realized either by multiple impedance branch circuits of one connection terminal, which is beneficial to improve the integration level of the connection terminal; or by impedance branch circuits of a plurality of connection terminals, which is beneficial to improve assembly and retrofitting flexibility.

Further, the illumination lamp may include a first light emitting element and a second light emitting element having different color temperatures, and the first light emitting element and the second light emitting element are respectively connected in the first driving circuit and the second driving circuit. Two impedance branch circuits can be respectively connected to the two driving circuits to achieve respective adjustments of operating currents of the first and second light emitting elements, and further to achieve setting or adjustment of the overall color temperature of the illumination lamp. Connection of the two impedance branch circuits in the two driving circuits respectively can be realized via two impedance branch circuits of one connection terminal, which is beneficial to improve the integration level of the connection terminal; or by impedance branch circuits of two connection terminals respectively, which is beneficial to improve assembly and retrofitting flexibility.

Although the present disclosure has been described above, the present disclosure is not limited thereto. It should be understood by those skilled in the art that various changes and modifications may be made without departing from the spirit and scope of the disclosure, and therefore, the scope of the disclosure should be limited by the scope of the claims.

What is claimed is:

1. A connection terminal, comprising: at least one impedance branch circuit, wherein each of the at least one impedance branch circuit comprises:

one or more impedance elements;

two first conductive connectors, each of the two first conductive connectors having a first end and a second end, wherein the first ends of the two first conductive connectors are configured to be coupled with a driving power supply and an illumination lamp respectively, and the second ends of the two first conductive connectors are configured to be coupled with two ends of the one or more impedance elements respectively; and at least one second conductive connector, each of the at least one second conductive connector having a first end and a second end, wherein the second end of the second conductive connector is disconnected or short-circuited with the second end of the first conductive connector, and the first end of the first conductive connector and the first end of the second conductive connector are configured to be respectively coupled with the driving power supply and the illumination lamp, or are configured to be respectively coupled with the illumination lamp and the driving power supply.

2. The connection terminal according to claim 1, wherein the one or more impedance elements comprise a capacitor.

3. The connection terminal according to claim 2, wherein a capacitance of the impedance branch circuit ranges from 33 pF to 63 nF.

4. The connection terminal according to claim 1, wherein the impedance branch circuit comprises a plurality of impedance elements, with the plurality of impedance elements being connected in series or in parallel between the two first conductive connectors.

5. The connection terminal according to claim 1, further comprising:

a terminal body, being made of an insulating material, wherein the one or more impedance elements and the each first conductive connector are disposed in the terminal body, and the first end of the each first conductive connector is provided with a port exposed outside the terminal body.

6. The connection terminal according to claim 5, wherein the two ports of the first ends of the two first conductive connectors are disposed at a same end of the terminal body; or the two ports of the first ends of the two first conductive connectors are respectively disposed at two ends of the terminal body.

7. The connection terminal according to claim 1, wherein the driving power supply is configured to output a high frequency alternating current power and the illumination lamp is configured to be driven by a high frequency alternating current power.

8. A connection terminal, comprising: at least one impedance branch circuit, wherein each of the at least one impedance branch circuit comprises:

one or more impedance elements;

two first conductive connectors, each of the two first conductive connectors having a first end and a second end, wherein the first ends of the two first conductive connectors are configured to be coupled with a driving power supply and an illumination lamp respectively, and the second ends of the two first conductive connectors are configured to be coupled with two ends of the one or more impedance elements respectively; and a plurality of second conductive connectors, each of the plurality of second conductive connectors having a first end and a second end, wherein the first ends of a group of second conductive connectors are configured to be respectively coupled with the driving power supply and the illumination lamp, the second ends of the group of second conductive connectors are disconnected or short-circuited with each other, and the group of second conductive connectors comprises two second conductive connectors.

9. The connection terminal according to claim 8, wherein the driving power supply is configured to output a high frequency alternating current power and the illumination lamp is configured to be driven by a high frequency alternating current power.

10. An illumination device, comprising:

a driving power supply, an illumination lamp, and a connection terminal;

wherein the connection terminal comprises at least one impedance branch circuit, each of the at least one impedance branch circuit comprises: one or more impedance elements; two first conductive connectors, each of the two first conductive connectors having a first end and a second end, wherein the first ends of the two first conductive connectors are configured to be coupled with the driving power supply and the illumination lamp respectively, and the second ends of the two first conductive connectors are configured to be coupled with two ends of the one or more impedance elements respectively; and at least one second conductive connector, each of the at least one second conductive connector having a first end and a second end, wherein the second end of the second conductive connector is disconnected or short-circuited with the second end of the first conductive connector, and the first end of the first conductive connector and the first end of the second conductive connector are configured to be respectively coupled with the driving power supply and the illumination lamp, or are configured to be respectively coupled with the illumination lamp and the driving power supply;

wherein input ends of the driving power supply are configured to be coupled with an alternating current power grid, and output ends of the driving power supply are configured to be coupled with two ends of the illumination lamp to form a driving circuit, and the two first conductive connectors of at least one impedance branch circuit of the connection terminal are connected to the driving circuit.

11. The illumination device according to claim 10, wherein the one or more impedance elements between the two first conductive connectors of the at least one impedance branch circuit are connected in series with the illumination lamp.

12. The illumination device according to claim 10, wherein the driving power supply is configured to output a high frequency alternating current power, and the illumination lamp comprises: an AC-DC conversion circuit and at least one light emitting element, input ends of the AC-DC conversion circuit are coupled with the output ends of the driving power supply, and output ends of the AC-DC conversion circuit are coupled with two ends of the at least one light emitting element, and the AC-DC conversion circuit is configured to convert an alternating current power into a direct current power.

13. The illumination device according to claim 10, wherein an impedance of the one or more impedance elements of the connection terminal is determined by a lumen output of the illumination lamp.

14. The illumination device according to claim 10, wherein the illumination device comprises a plurality of illumination lamps being connected in series in the driving circuit;

the illumination device comprises one or more connection terminals, and at least one impedance branch circuit of the one or more connection terminals is coupled to the driving circuit.

15. The illumination device according to claim 10, wherein the illumination device comprises a plurality of illumination lamps, and the driving power supply comprises a plurality groups of output ends, with two ends of each of the plurality of illumination lamps being coupled with one of the plurality groups of output ends of the driving power supply so as to form a plurality of driving circuits;

wherein the illumination device comprises one connection terminal, the one connection terminal comprises a plurality of impedance branch circuits, and the plurality of impedance branch circuits of the one connection terminal are respectively coupled to the plurality of driving circuits, or the illumination device comprises a plurality of connection terminals, and the impedance branch circuits of the plurality of connection terminals are respectively coupled to the plurality of driving circuits.

16. The illumination device according to claim 15, wherein the driving power supply comprises a common output end, the plurality groups of output ends of the driving power supply share the common output end, one end of each of the plurality of illumination lamps is coupled with the common output end; the illumination device comprises a connection terminal, an impedance branch circuit of the connection terminal is connected in series between the common output end of the driving power supply and the one end of the each illumination lamp.

17. The illumination device according to claim 10, wherein the illumination lamp comprises a lamp tube, the lamp tube is double ended or single ended, the double ended lamp tube comprises a straight lamp tube, and the single ended lamp tube comprises a U-shaped, ring-shaped, H-shaped, double U-shaped, square-shaped, sphere-shaped or spiral-shaped lamp tube.

18. The illumination device according to claim 10, wherein the illumination lamp comprises a first light emitting element and a second light emitting element with different color temperatures;

the driving power supply comprises a first group of output ends and a second group of output ends, the first group of output ends are coupled with two ends of the first light emitting element to form a first driving circuit, and the second group of output ends are coupled with two ends of the second light emitting element to form a second driving circuit; and the illumination device comprises one connection terminal, the one connection terminal comprises at least two impedance branch circuits, and two impedance branch circuits of the one connection terminal are respectively coupled to the first driving circuit and the second driving circuit, or the illumination device comprises two connection terminals, and impedance branch circuits of the two connection terminals are respectively coupled to the first driving circuit and the second driving circuit.

19. The illumination device according to claim 18, wherein the illumination lamp further comprises:

a first AC-DC conversion circuit, input ends of the first AC-DC conversion circuit being coupled with the first group of output ends of the driving power supply, output ends of the first AC-DC conversion circuit being coupled with the two ends of the first light emitting element, and the first AC-DC conversion circuit being configured to convert an alternating current power into a direct current power; and a second AC-DC conversion circuit, input ends of the second AC-DC conversion circuit being coupled with the second group of output ends of the driving power supply, output ends of the second AC-DC conversion circuit being coupled with the two ends of the second light emitting element, and the second AC-DC conversion circuit being configured to convert an alternating current power into a direct current power.

20. An illumination device, comprising:

a driving power supply, an illumination lamp, and a connection terminal;

wherein the connection terminal comprises at least one impedance branch circuit, each of the at least one impedance branch circuit comprises: one or more impedance elements; two first conductive connectors, each of the two first conductive connectors having a first end and a second end, wherein the first ends of the two first conductive connectors are configured to be coupled with the driving power supply and the illumination lamp respectively, and the second ends of the two first conductive connectors are configured to be coupled with two ends of the one or more impedance elements respectively; and a plurality of second conductive connectors, each of the plurality of second conductive connectors having a first end and a second end, wherein the first ends of a group of second conductive connectors are configured to be respectively coupled with the driving power supply and the illumination lamp, the second ends of the group of second conductive connectors are disconnected or short-circuited with each other, and the group of second conductive connectors comprises two second conductive connectors;

wherein input ends of the driving power supply are configured to be coupled with an alternating current power grid, and output ends of the driving power supply are configured to be coupled with two ends of the illumination lamp to form a driving circuit, and the two first conductive connectors of at least one impedance branch circuit of the connection terminal are connected to the driving circuit.

* * * * *